US005775499A

United States Patent [19]

Budert

[11] Patent Number: 5,775,499

[45] Date of Patent: Jul. 7, 1998

[54] TOOL HOLDING APPARATUS

[76] Inventor: Günter H. Budert, Pflagstrasse 7, D-89429 Bachhagel, Germany

[21] Appl. No.: 697,445

[22] Filed: Aug. 21, 1996

[30] Foreign Application Priority Data

Aug. 21, 1995 [DE] Germany ..... 295 13 388 U

[51] Int. Cl.[6] ..... B65D 85/28

[52] U.S. Cl. ..... 206/379; 206/349; 206/759; 211/69; 211/70.6

[58] Field of Search ..... 206/349, 372, 206/373, 376, 377, 379, 477, 759, 763, 765; 211/69, 70.6

[56] References Cited

U.S. PATENT DOCUMENTS

| | | | |
|---|---|---|---|
| 5,148,914 | 9/1992 | Budert et al. | 206/379 |
| 5,172,810 | 12/1992 | Brewer | 206/759 |
| 5,513,758 | 5/1996 | Lin | 211/70.6 |
| 5,535,881 | 7/1996 | Krivec | 206/477 |

FOREIGN PATENT DOCUMENTS

| | | | |
|---|---|---|---|
| 215290 | 11/1984 | Germany | 206/349 |
| 94 12 840.5 | 8/1994 | Germany . | |
| 2135279 | 8/1984 | United Kingdom | 206/349 |

*Primary Examiner*—David T. Fidei
*Attorney, Agent, or Firm*—McAndrews, Held & Malloy

[57] ABSTRACT

A tool holder for holding elongated tools, such as drill bits and the like. The tool holder includes a base member having upper and lower ends. A tool support member having upper and lower ends is pivotally mounted at its lower end to the base member. The upper end of the tool support element includes at least one opening which defines a tool retention channel. The opening is adapted to receive a base section of a tool. The tool holder further includes elastically deformably tool securing members secured to the tool support member proximate the tool retention channels. The tool securing member includes a base section which is affixed to the tool support element. The tool securing member includes a tool engaging face which securely engages a base section of a tool inserted into the tool retention channel. The tool securing members are aligned and biased such that the tool engaging face projects into a cross sectional area of the tool retention channel in order to frictionally engage tools when inserted into the tool retention channel. The tool holder according to the preferred embodiment of the present invention securely receives tools and avoids play between the tool and the holder. The tool holder on the preferred embodiment further prevents tools from falling out of the holder.

18 Claims, 2 Drawing Sheets

TOOL HOLDING APPARATUS

FIELD OF THE INVENTION

The present invention generally relates to a tool holder for securely retaining tools of the type having an elongated base. More specifically, the invention relates to a drill bit holder which securely retains base sections of the drill bits.

BACKGROUND OF THE INVENTION

In the past, drill bit holders have been proposed for storing and transporting drill bits such as the drill bit holder disclosed in German utility Patent Application Model 9412840.5. The drill bit holder of the '840 German model includes a base section, receiving means for receiving drill bits and a transparent cover. The receiving means and transparent cover are pivotally mounted to a base portion of the drill bit holder. A suspension device is also provided upon the base section of the holder. The base section is configured to be maintained at three elevations which, when the cover is in a closed state, project beyond the cover in a direction perpendicular thereto.

However, the drill bit holder of the '840 utility model has met with limited success. In particular, when tools are inserted into the openings in the receiving means, a large amount of play remains between the tool and the receiving means. Consequently, the tools move around within the receiving means during transportation, thereby generating a comparatively large amount of noise. Such movement also detracts from the sales presentation of the tools when within the holder. A further disadvantage of the holder of the '840 utility model is that, when the holder is open, individual tools or drill bits may easily fall out and be lost.

The aforementioned disadvantages are exaggerated when tool holders and drill bits are configured according to different standards. For instance, drill bits may be defined according to the metric system in terms of millimeters or centimeters, or may be defined based on the United States system in terms of inches. Drill bits defined according to one of the foregoing systems do not fit well within a drill bit holder built in accordance with the opposite system. Thus, drill bits defined in terms of inches do not fit well within a drill bit holder having openings in the receiving means defined in terms of the metric system. Due to this conversion difference, drill bits which are measured in terms of inches often must be inserted into excessively large openings within a holder produced according to the metric system. Alternatively, separate holders must be manufactured based on each measurement system.

A need remains for an improved tool holder which addresses and overcomes the above discussed deficiencies.

SUMMARY OF THE INVENTION

It is an object of the present invention to provide a tool holder for elongated tools which securely receives each tool to avoid excessive noise and to prevent tools from falling out of the holder.

It is a further object of the present invention to provide a tool holder which universally securely receives tools based on the U.S. and metric systems.

These and other objects are achieved by a tool holder having a base member with upper and lower ends pivotally mounted to a tool support member having upper and lower ends. The upper end of the support member includes at least one opening which defines a tool retention channel within the support member. The opening is adapted to receive a base section of the tool. The tool support member further includes at least one elastically deformable tool securing member having a base affixed to the tool support member and having a tool engaging face. The tool securing member is aligned and biased such that the tool engaging face securely engages a base section of the tool inserted into the tool retention channel in the support member. The elastically deformable tool securing member is arranged such that the tool engaging face thereof is normally biased to project to a position within a cross-sectional area of the retention channel to fall within a path along which the base section of the tool must be inserted. At least one elastically deformable member is provided per opening in the tool support member.

By providing an elastically deformable member to reduce the cross-sectional area of the tool retention channel, an elongated tool (e.g., a drill bit, a compass saw blade, a screwdriver, an abrasive pencil and the like) which is inserted into the tool retention channel is retained in a frictionally locked manner within the channel by the elastically deformable member. Consequently, no excessive play is provided between the tool and the tool support member, thereby reducing noise and preventing the tools from falling out of the holder.

In an alternative embodiment, multiple elastically deformable members may be provided within each tool retention channel. The outer tool engaging face out of each deformable member may be notched or cut in an arcuate manner in order to center the tool within the retention channel. By centering each tool within its respective retention channel, tools within adjacent openings are located in optimal distance from one another and therefore can be easily removed from the tool holder.

According to one alternative embodiment, the elastically deformable member may be designed as a tab or tongue which is secured at its base to one end of the receiving means. An opposite end of the tab or tongue is configured as the tool engaging face. By designing the elastically deformable member as a tab or tongue, it may be produced in a simple and cost effective manner and, alternatively, integrally with the receiving means. As a further alternative, the tool engaging face may be formed with a recess or cut-out designed in the form of a prism, arc and the like. By designing the tool engaging face in the form of a prism, two points of contact are afforded between the engaging face and the tool. A relatively high surface contact pressure is applied between the elastic member and the tool in order to retain firmly the tool within the receiving means.

When the tool engaging face is designed in the form of an arc, the diameter of the arc may be adapted to correspond to the diameter of the tool intended to be received, thereby maximizing the surface area of contact between the tool engaging face and the tool.

As a further alternative, the receiving means and the elastically deformable member may be produced as a single integral piece (e.g., such as from plastic and the like). This integral configuration enables the entire tool holder to be produced easily and in a cost effective manner. Alternatively, the receiving means and the elastically deformable member may be produced separately and then affixed to one another.

As a further alternative, the receiving means may be mounted to the base in such a manner as to be pivoted about an axis of rotation with respect to the base in order to ensure quick and simple access to the tools stored within the holder. This pivotal interconnection renders it possible to swing the receiving means outward with the tools contained therein to afford quick access.

Similarly, the cover may be pivotally mounted at the same axis of rotation as the receiving means. By interconnecting the base, receiving means and cover about a single axis of rotation, it is possible for the individual components of the tool holder to be mounted in a corresponding simple and cost effective manner.

As an alternative, the base section and the receiving means may be produced as one piece and the cover may be connected therewith in order to be displaced in a linear manner with respect to the base section.

DETAILED DESCRIPTION OF THE PREFERRED EMBODIMENT

Figure 1:
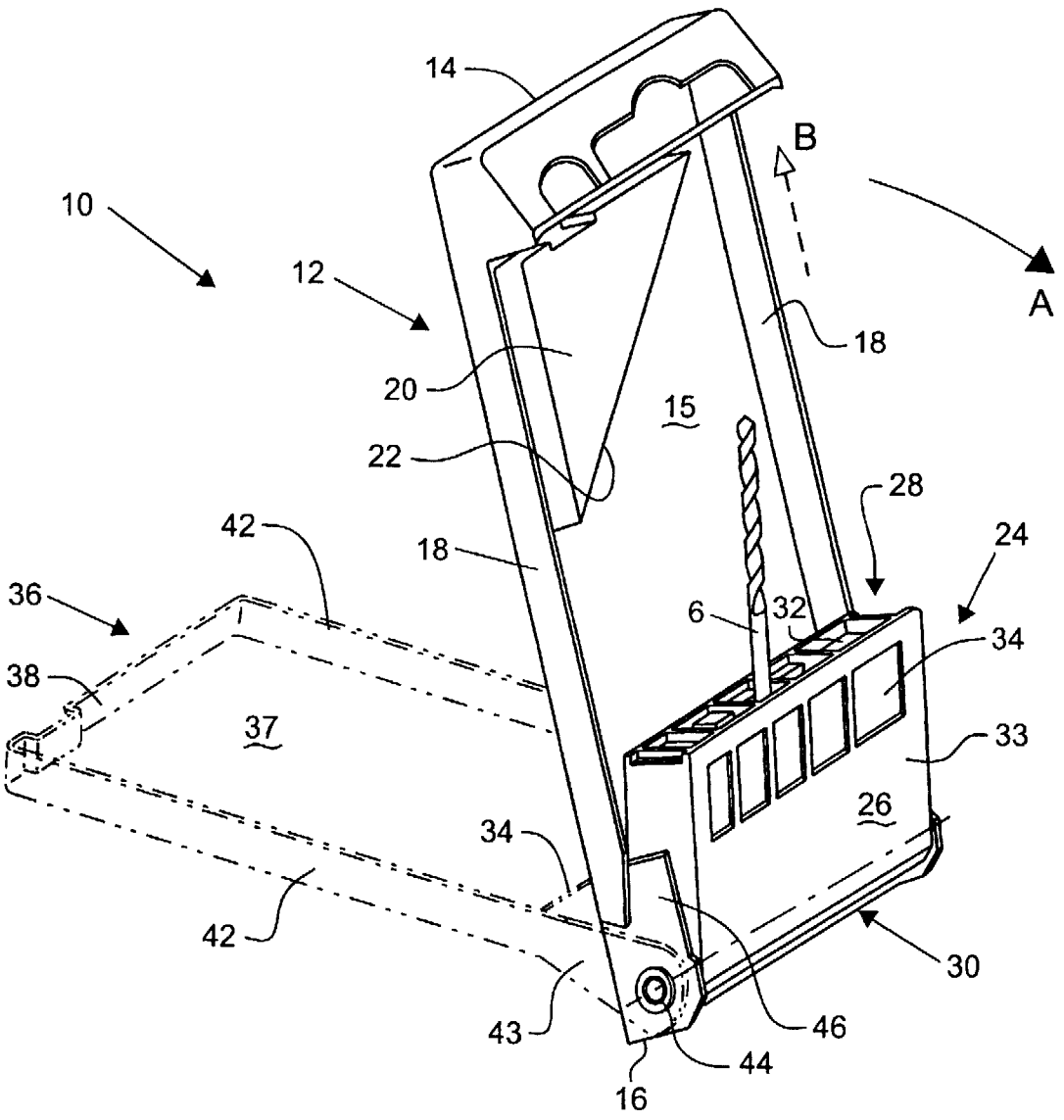
FIG. 1 illustrates a perspective view of a tool holder according to a preferred embodiment of the present invention when in an open state.

FIG. 1 generally illustrates a tool holder denoted by the reference numeral 10. The tool holder 10 includes a rectangular base member 12 having an upper end 14 and a lower end 16. The base member 12 further includes side walls 18. Within the base member 12, a triangularly shaped tool block 20 is provided proximate the upper end 14. The tool block 20 includes a tool engaging edge 22 extending upward diagonally across the interior of the base member 12. The tool block 20 assists in preventing tools from inadvertently falling out of the holder since, when in a closed position, the upper ends of the tools are located proximate and in line with the tool engaging edge 22. When in an open position, the upper ends of the tools are pivotally rotated outward away from the tool block 20 and thus may be removed from the holder 10.

The tool holder 10 further includes receiving means 24 which may include a tool support member 26 formed in a rectangular block configuration. The tool support member 26 includes an upper end 28 and a lower end 30. Openings 32 are provided along the upper end 28 to define tool retention channels (as explained below in connection with FIGS. 2–4). A front face 33 of the tool support member 26 may include windows 34 to enable the user to view tools located therein. By way of example, size indicia upon the tools may be aligned with windows 34 thereby allowing the user to identify whether the tool corresponds to a ½ drill bit, ¾ in. drill bit and the like. The openings 32 receive the base section of the tools 6 in a secure manner as explained below.

Optionally, a cover 36 may be provided. The cover 36 may include an upper end 38, a lower end 40 and sidewalls 42. The sidewalls 42 include lower extension 43 which align with the lower ends of the base member 12 and tool support member 26. A pivot pin 44 may extend through holes in the extension 43, lower end 14 and lower end 30 in order to pivotally mount the cover 36, tool support member 26 and base member 12 to one another. Optionally, a stop lever 46 may be provided. The cover 36 may be pivoted in the direction in arrow A until the extensions 43 rotate into an abutting relation with the stop levers 36, thereby preventing further rotation in the direction arrow A (as shown in its stopped position in FIG. 1). In this manner, the cover 36 affords a support member for the tool holder to rest upon.

As shown in FIG. 1, the tool support member 26 also pivotally rotates in the direction arrow of A a slight distance outward from the base member 12 in order that the tools 6 may be removed without contacting the tool engaging edge 22. When in the closed position, the tool support member 26 rotates inward into an engaging relation with a back surface 15 of the base member 12. When in the closed position, the surfaces 15 and 37 of the base member 12 and cover 36 sandwich the tools and the receiving means 24 therebetween. Optionally, the cover 36 may be configured from a transparent material in order that the user may view tools when the holder is in a closed position.

Figure 2:
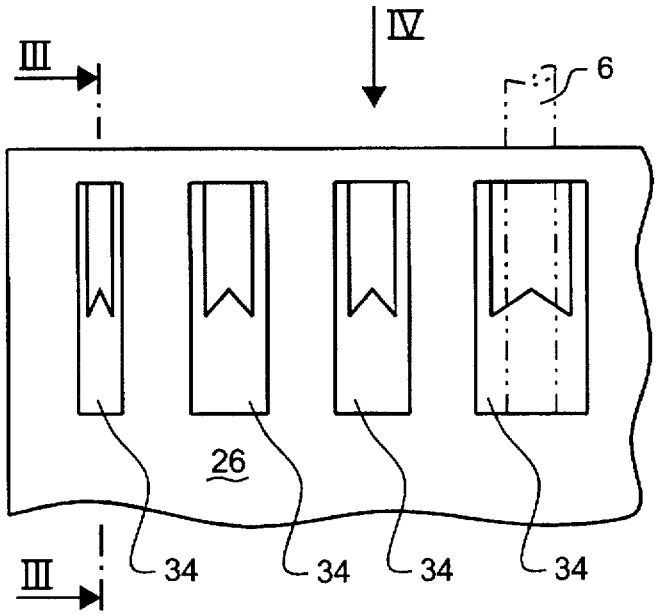
FIG. 2 illustrates a front view of the receiving means for receiving tools according to the preferred embodiment of the present invention.
Figure 3:
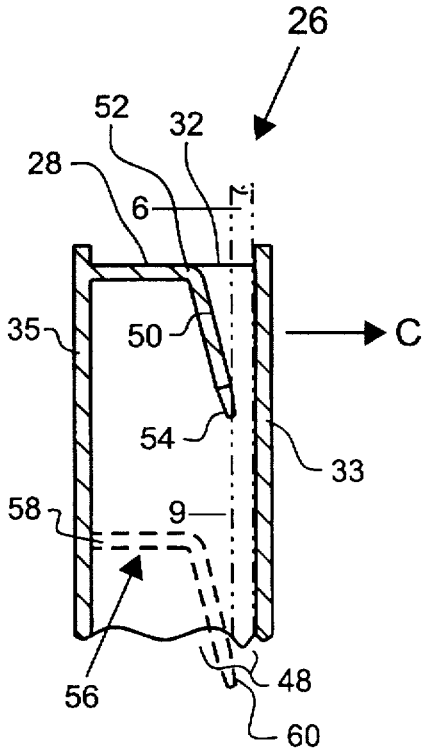
FIG. 3 illustrates a side sectional view taken along line 3—3 in FIG. 2 of a tool retention channel of the receiving means according to preferred embodiment of the present invention.
Figure 4:
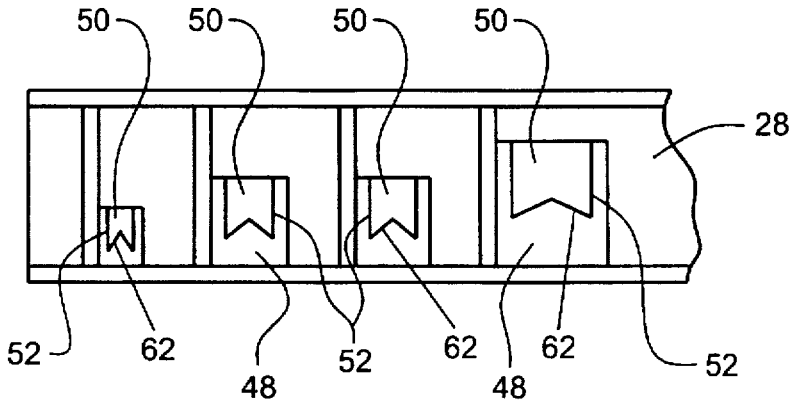
FIG. 4 illustrates a top plan view of the receiving means according to a preferred embodiment of the present invention.

Next, the discussion turns to FIGS. 2–4 for a more detailed explanation of the receiving means 24. FIG. 2 illustrates a front view of the tool support member 26 including windows 34. FIG. 3 illustrates a side-section view taken along line 3—3 in FIG. 2. As shown in FIG. 3, the tool support member 26 includes front and back walls 33 and 35. The upper end 28 includes an opening 32 therethrough for receiving tool 6. In the example of the preferred embodiment, a base shaft 9 of the tool 6 is axially slid downward through the opening 32. The opening 32 defines the entrance to a channel 48 (generally denoted by bracket 48). Each channel 48 is adapted to receive a shaft 9 of a corresponding tool 6. The shaft 9 is slid along a path parallel to the longitudinal axis of the channel 48.

An elastic member 50 is securely mounted to the tool support member 26 and includes a base end 52 and a tool engaging end 54. In the example of FIG. 3, the elastic member 50 is formed integrally with the upper end 28 of the tool support member 26 with the back end 52 extending downward at an angle from a rear surface of opening 32. The elastic members 50 are normally biased in a direction indicated by arrow C to a position within the channel 48. The channels 48 and openings 32 are each defined with a predetermined cross-sectional area sufficient to receive a shaft 9 of a desired tool 6. The elastic members 50 are normally biased to a position within a cross-sectional area of the channel 48 in order to ensure that the tool engaging end 54 contacts the shaft of any tool 6 received within the channel 48. As the shaft 9 is slid into the channel 48, the elastic member 50 is biased in a direction opposite to arrow C, while retaining a friction force against the shaft 9. This friction force binds the shaft 9 between the elastic member 50 and the front wall 33 of the tool support member 26, thereby securely retaining the tool 6 within the receiving means 20. Optionally, multiple elastic members 50 may be provided within each channel 48, as illustrated by the second elastic member 56 in FIG. 3. The second elastic member 56 includes a back end 58 securely mounted to the back wall 35 and a tool engaging end 60 projecting into the cross-section area of the channel 48 to securely engage the shaft 9 of the tool 6.

Turning to FIG. 4, a top plan view is illustrated of the tool support member 26 configured to have four tool retention channels 48. Optionally, the tool engaging end 52 of each elastic member 50 may include a cut-out recess formed in a arcuate, notched, prism shaped and the like. In the example of FIG. 4, each tool engaging end 54 includes a prism shaped outer end 62. To securely retain each tool in a laterally centered position as viewed from the front of the tool support member 26.

According to the preferred embodiment, the elastic members 50 may be configured as tabs or tongues which are provided in one piece within the receiving means 24. The elastic members 50 afford a high surface contact pressure against each tool and, in turn, secure the individual tool 6 against the receiving means 24, thereby preventing play and tools from falling out of the holder.

Optionally, provision may be made for the base member 12 to be produced in one piece with the receiving means 24. Optionally, the cover 36 may be configured to be removed in a linear manner with respect to the base member 12 upward in the direction of arrow B (FIG. 1). According to this alternative embodiment, in order to open the tool holder, the cover is not pivoted about an axis of rotation as is illustrated in FIG. 1. Instead, the cover is merely displaced upward in a linear manner until the tools can be removed from the receiving means 24.

As a further alternative, the elastic members 50 may be provided proximate the opening 32 in order to clamp the inserted tools without play and to prevent the tools from falling out of the holder. By way of example, the elastic member 50 may be formed from a circular ring of rubber material, such as a washer. The washer may be centered over the opening and configured to receive corresponding tools through a center aperture in the washer. The washer would include a central hole smaller than the diameter of a tool. The diameter of the hole would expand to receive the tool, while being securely retained against the exterior surface of the tool. As yet a further option, the washer may be sliced in a radial direction to afford a larger range of flexibility.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A tool holder for holding tools of the type having an elongated base section, said holder comprising:

a base member having upper and lower ends;

a tool support member having upper and lower ends, said lower end of said tool support member being mounted to said lower end of said base member, said upper end of said tool support member including at least one opening that defines a tool retention channel within said tool support member, said opening being adapted to receive a base section of a tool; and at least one elastically deformable tool securing member having a base affixed to said tool support member and having a tool engaging end, said tool securing member being aligned and biased such that said tool engaging end securely engages a base section of a tool inserted into said retention channel in said tool support member, wherein said tool engaging end of said tool securing member includes a cut-out therein in the shape of a prism for receiving the tool.

2. A tool holder according to claim 1, further comprising:

a cover having upper and lower ends, said lower ends of said cover, base member and tool support member being pivotally mounted to one another such that said base member and cover enclose said tool support member when rotated to a closed position.

3. A tool holder according to claim 1, wherein said retention channel in said tool support member includes a longitudinal axis, along which the base section of the tool is slidably received, said retention channel including a cross-section and wherein said tool engaging end of said tool securing member is normally biased to project to a position within said cross-sectional area of said retention channel along a path of the base section of the tool.

4. A tool holder according to claim 1, wherein said tool support member includes an elongated tongue angled along an obtuse angle and having an outer end corresponding to said tool engaging end for frictionally engaging the tool.

5. A tool holder according to claim 1, wherein said tool securing member includes a tab or tongue integrally affixed at one end to said tool support member.

6. A tool holder according to claim 1, wherein said tool securing member includes a tab or tongue which is securely affixed to one end of said tool support member.

7. A tool holder for holding tools of the type having an elongated base section, said holder comprising:

a base member having upper and lower ends;

a tool support member having upper and lower ends, said lower end of said tool support member being mounted to said lower end of said base member, said upper end of said tool support member including at least one opening that defines a tool retention channel within said tool support member, said opening being adapted to receive a base section of a tool; and at least one elastically deformable tool securing member having a base affixed to said tool support member and having a tool engaging end, said tool securing member being aligned and biased such that said tool engaging end securely engages a base section of a tool inserted into said tool retention channel in said tool support member, wherein said tool engaging end of said tool securing member includes a cut-out therein in the shape of an arc for receiving the tool.

8. A tool holder according to claim 7, further comprising:

a cover having upper and lower ends, said lower ends of said cover, base member and tool support member being pivotally mounted to one another such that said base member and cover enclose said tool support member when rotated to a closed position.

9. A tool holder according to claim 7, wherein said retention channel in said tool support member includes a longitudinal axis, along which the base section of the tool is slidably received, said retention channel including a cross-section and wherein said tool engaging end of said tool securing member is normally biased to project to a position within said cross-sectional area of said retention channel along a path of the base section of the tool.

10. A tool holder according to claim 7, wherein said tool support member includes an elongated tongue angled along an obtuse angle and having an outer end corresponding to said tool engaging end for frictionally engaging the tool.

11. A tool holder according to claim 7, wherein said tool securing member includes a tab or tongue integrally affixed at one end to said tool support member.

12. A tool holder according to claim 7, wherein said tool securing member includes a tab or tongue which is securely affixed to one end of said tool support member.

13. A tool holder for holding tools of the type having an elongated base section, said holder comprising:

a base member having upper and lower ends;

a tool support member having upper and lower ends, said lower end of said tool support member being mounted to said lower end of said base member, said upper end of said tool support member including at least one opening that defines a tool retention channel within said tool support member, said opening being adapted to receive a base section of a tool; and at least two elastically deformable tool securing members associated with each tool retention channel and having bases affixed to said tool support member and having tool engaging ends, said tool securing members being aligned and biased such that said tool engaging ends securely engage a base section of a tool inserted into said tool retention channel in said tool support member at first and second locations.

14. A tool holder according to claim 13, further comprising:

a cover having upper and lower ends, said lower ends of said cover, base member and tool support member being pivotally mounted to one another such that said base member and cover enclose said tool support member when rotated to a closed position.

15. A tool holder according to claim 13, wherein said retention channel in said tool support member includes a longitudinal axis, along which the base section of the tool is slidably received, said retention channel including a cross-section and wherein said tool engaging end of said tool securing member is normally biased to project to a position within said cross-sectional area of said retention channel along a path of the base section of the tool.

16. A tool holder according to claim 13, wherein said tool support member includes an elongated tongue angled along an obtuse angle and having an outer end corresponding to said tool engaging end for frictionally engaging the tool.

17. A tool holder according to claim 13, wherein said tool securing member includes a tab or tongue integrally affixed at one end to said tool support member.

18. A tool holder according to claim 13, wherein said tool securing member includes a tab or tongue which is securely affixed to one end of said tool support member.

* * * * *